United States Patent [19]

Goettl

[11] 4,333,887

[45] Jun. 8, 1982

[54] AUTOMATIC FLUSHING AND DRAINING APPARATUS FOR EVAPORATIVE COOLERS

[76] Inventor: Adam D. Goettl, 4960 E. Palomino Dr., Phoenix, Ariz. 85018

[21] Appl. No.: 296,775

[22] Filed: Aug. 27, 1981

Related U.S. Application Data

[63] Continuation-in-part of Ser. No. 222,552, Jan. 5, 1981, Pat. No. 4,289,713, which is a continuation-in-part of Ser. No. 115,041, Jan. 24, 1980, Pat. No. 4,255,361, which is a continuation-in-part of Ser. No. 7,027, Jan. 29, 1979, Pat. No. 4,192,832.

[51] Int. Cl.[3] ..... B01F 3/04

[52] U.S. Cl. ..... 261/27; 62/171; 62/310; 137/132; 137/143; 261/29; 261/36 R; 261/DIG. 3; 261/DIG. 46

[58] Field of Search ..... 261/29, 27, 36 R, 70, 261/DIG. 3, DIG. 46; 62/310, 171, DIG. 16; 137/132, 143, 150.5

[56] References Cited

U.S. PATENT DOCUMENTS

| | | | |
|---|---|---|---|
| 545,566 | 9/1895 | Wrigley | 137/143 X |
| 1,834,381 | 12/1931 | Caps | 137/132 |
| 1,950,345 | 3/1934 | Williams | 261/DIG. 46 |
| 2,580,826 | 1/1952 | Osburn et al. | 261/DIG. 46 |
| 2,646,061 | 7/1953 | Bottum | 261/DIG. 46 |
| 2,828,761 | 4/1958 | Weibert, Jr. | 137/132 |
| 3,332,672 | 7/1967 | Schipper | 261/DIG. 46 |
| 3,643,930 | 2/1972 | Schulze, Sr. | 261/DIG. 46 |
| 3,867,485 | 2/1975 | Yeagle | 261/DIG. 46 |
| 4,129,140 | 12/1978 | Carlin | 261/27 X |

FOREIGN PATENT DOCUMENTS

| | | | |
|---|---|---|---|
| 1891 | of 1891 | United Kingdom | 137/132 |

*Primary Examiner*—Richard L. Chiesa
*Attorney, Agent, or Firm*—Herbert E. Haynes, Jr.

[57] ABSTRACT

Apparatus for periodically draining, flushing and replacing the water supply in an evaporative cooler during operation thereof and for completely draining the cooler when its operation is terminated. The apparatus includes a siphon drain valve mounted in the sump of the cooler and configured for movement between siphoning and non-siphoning positions with the movement being controlled by a solenoid. When the cooler is in normal operation, the solenoid is deenergized which places the siphon drain valve in the non-siphoning position and when in such normal operation, the water supply will increase in mineral salt concentration and other cooler damaging contaminants. At periodic intervals, such as under control of a time clock, the apparatus is switched to its draining, flushing and water replacing operation mode. This is accomplished by energizing the solenoid to initiate the siphoning action of the siphon drain valve to drain the water from the cooler. The usual make-up water supply device of the evaporative cooler will operate so that the incoming fresh water will dilute the draining water and thus flush the sump. The drainage flow rate is greater than the flow rate of the incoming fresh water, thus, when the drainage is completed, the siphon drain valve will automatically lose its prime, which allows the sump to be refilled with the incoming fresh water. During this refilling, the solenoid is deenergized to return the siphon drain valve to its non-siphoning position and normal cooler operation resumes. To accomplish cooler drainage at the termination of cooler operation, the same solenoid and siphon drain valve operations occur with the cooler's fresh water make-up device shutoff so that the drained water supply will not be replaced.

17 Claims, 7 Drawing Figures

AUTOMATIC FLUSHING AND DRAINING APPARATUS FOR EVAPORATIVE COOLERS

CROSS REFERENCE TO RELATED APPLICATIONS

This application is a continuation-in-part of a copending U.S. patent application Ser. No. 222,552, filed Jan. 5, 1981, which issued as U.S. Pat. No. 4,289,713, on Sept. 15, 1981, which is a continuation-in-part of a copending U.S. patent application Ser. No. 115,041, filed Jan. 24, 1980, which issued as U.S. Pat. No. 4,255,361, on Mar. 10, 1981, which is a continuation-in-part of a copending U.S. patent application Ser. No. 007,027, filed on Jan. 29, 1979, which issued as U.S. Pat. No. 4,192,832, on Mar. 11, 1980, all by the same inventor.

BACKGROUND OF THE INVENTION

1. Field of the Invention

This invention relates to evaporative coolers and more particularly to an improved automatic flushing and draining apparatus for use with evaporative coolers 2. Description of the Prior Art Evaporative coolers of the type having an air handler mounted in a cabinet for drawing air into the cooler through wettable cooler pads and delivering the evaporatively cooled air to a point of use, have the necessary water supply contained within a floor pan or sump. The water level within the sump is maintained at a predetermined level by a float controlled inlet valve that is suitably connected to a source of water under pressure, such as a domestic water line. A pump is mounted in the sump and operates to supply water to the cooler's water distribution system which in turn distributes the water to the cooler pads. The wet cooler pads will cool the air being drawn therethrough by the air handler in accordance with the well known evaporative principle, and the unevaporated water will drain under the influence of gravity from the pads and return to the sump.

During such operation, the water, which inherently contains minerals, such as sodium and calcium chlorides and other impurities, will increase as to its concentration of those minerals due to the evaporation process. As the mineral concentration increases, the rate of precipitation will also increase which results in mineral deposits, or scaling, of the various cooler components. Such mineral deposition causes calcification of the cooler pads, clogging of the water passages, corrosion of the metal and the like, but the most serious problem is with the electric motors and wiring. When the mineral salts, which are electrovalent compounds, are deposited on the wiring terminals, and the various parts of the electric motors themselves, they attack those components and cause premature failures. Further, those compounds are hygroscopic in nature and will thus attract moisture out of the atmosphere even when the evaporative cooler is inoperative, and thus, salt induced deterioration is a continuing process. To keep such mineral deposits to a minimum, the cooler should be periodically drained, flushed, and refilled with fresh water. However, since such draining, flushing and refilling is something which should be accomplished on a regular and a rather frequent schedule, as determined by the characteristics of the water, it is something that is almost always forgotten, or simply ignored.

The above described problem of mineral deposition is compounded by the fact that the water is stored within the sump which serves as a reservoir. Thus, the various cooler components are exposed to a relatively large body of water in the bottom of its cabinet. Unless the sump is drained at the end of a cooling season, or prior to other periods of nonuse, such direct exposure of the components to the water body is something that can, and often is, continuous whether the cooler is operating or not. Draining of the sump preparatory to a period of nonuse is no guarantee that the sump will remain dry for the period of nonuse in that leakage from the inlet supply line and/or rain entering the cooler cabinet through the pads will collect in the sump.

The above described problems and shortcomings of prior art evaporative coolers is something that has long been recognized and various attempts have been made to solve, or at least, minimize some of those problems. For example, devices which dispense chemicals into the water to reduce mineral concentration and deposition problems have been suggested, however, such devices have not received widespread commercial acceptance due to the minimal benefits derived, cost, and the maintenance requirements.

One particular prior art device has been suggested in U.S. Pat. No. 2,828,761, for automatically draining, flushing, and replacing the water in the cooler's sump and for draining a large portion of the water therefrom when the inlet water supply to the sump is shutoff. Briefly, this prior art device includes a sheet metal dam which is located within the sump of the cooler. A one-way check valve is located in the wall of the dam so that water is free to flow from the main reservoir portion of the sump into the relatively smaller dam portion but is prevented from flowing in a reverse direction. A pump and siphon valve are located inside the dam and a float controlled water inlet valve is located in the main reservoir portion of the sump to maintain the water level in the sump and in the dam, due to the free flow through the checking valve, at a predetermined level. During operation of the cooler, the pump delivers water from the dam portion to the cooler's water distribution system which in turn supplies water to the cooler pads, and the unevaporated water will return from the pads, by gravity, to the main reservoir portion of the sump. When the pump is turned off, water in the cooler's water distribution system will drain back into the dam area only, due to the reverse flow checking provided by the check valve, thus raising the water level therein to a point where it primes the siphon valve. When the siphon valve is so primed, water in the dam will be drained therefrom and the water in the main reservoir portion of the sump will flow through the check valve into the dam and will exit the dam through the siphon valve. When the water supply is left on during such an operation, the result is that a draining, flushing and water replacement action takes place, and due to the outlet and siphon valve being sized to drain the sump at a faster rate than the water inlet line can replace the water, the water level will drop until the siphon valve looses its prime, whereupon refilling of the sump with fresh water takes place under control of the float operated inlet valve. This same operation occurring when the water supply to the cooler is shutoff results in draining of most of the water from the sump.

This particular prior art flushing and draining device has not received commercial acceptance for several reasons. In the first place, the amount of water contained in the water distribution plumbing system of an evaporative cooler is quite small and will, in most cases, be insufficient to achieve priming of the siphon valve. Secondly, the check valve of this prior art structure is a constant source of problems, in that the water pressure differential on the opposite sides thereof is all that can be relied upon for opening and closing of the valve, and that pressure differential is exceedingly small. The small pressure differential relied on to open and close the check valve precludes the use of a spring or other device to bias the valve toward its closed position. Therefore, the check valve is a passive rather than a positively acting device, and achieving a fully closed position when such a state is critical is oftentimes not achieved. To illustrate this point, there can be no leakage through the check valve when the draining cycle is initiated in that such leakage would prevent the water level in the dam from reaching the point where the siphon valve is primed. In addition to the passive action of the check valve, it by necessity, is operated under water and this subjects the valve to corrosion, scaling and the like, and the valve is often jammed by foreign matter such as dirt, wood shavings from the excelsior pads and the like. Thirdly, this prior art device is incapable of completely draining all of the water from the dam and the main reservoir portion of the sump in that both the check valve and the inlet to the siphon valve are spaced upwardly from the bottom of the sump. Therefore, the desirability of draining the sump when the cooler is inoperative cannot be completely achieved and a relatively large surface area of water will remain. Further, when the pump is shutoff to accomplish a draining, flushing and water replacement cycle, water will not be supplied to the cooler pads for a considerable length of time due to the amount of water that must be drained and replaced to fill the entire relatively large sump before normal operation can be resumed. Since warm air will continue to be drawn through the pads by the air handler during such a cycle, the pads will dry out rather rapidly, and upon drying, dust, dirt and the like, will be extracted from the pads by the aid moving therethrough.

In addition to the inherent problems of this particular prior art structure, it does nothing to remove the cooler components from direct exposure to the water in the sump either during operation or during nonuse of the evaporative cooler, and is incapable of automatically draining rain water, or the like which enters the cooler during nonuse periods.

Therefore, a need exists for a new and improved automatic flushing and draining apparatus for evaporative coolers which overcomes some of the problems and shortcomings of the prior art.

SUMMARY OF THE INVENTION

In accordance with the present invention, a new and improved automatic flushing and draining apparatus for evaporative coolers is disclosed. In a first embodiment, the apparatus includes a reservoir tank, which may be integrally formed, or may be suitably attached to the floor pan of the evaporative cooler so as to be located immediately below an opening formed in the floor pan. A pump, solenoid operated siphon drain valve and a float controlled fresh water inlet valve are located in the reservoir tank, with the pump being used to supply water from the tank to the cooler's water distribution system, the solenoid operated siphon drain valve being used during the flushing and draining operations and the float controlled water supply inlet valve being operable to maintain the water level in the reservoir tank at a predetermined level.

In operation, the apparatus of the present invention will deliver water from the tank to the cooler's water distribution system which directs the water to the cooler's pads. Unevaporated water from the cooler pads returns by gravity into the floor pan of the cooler and will pass through the opening thereof into the tank. To place the apparatus of the present invention in a draining, flushing and water replacement operational mode, the pump is turned off, the water inlet supply is left on, and the solenoid operated siphon drain valve is energized for priming thereof. Such priming of the siphon drain valve will drain the reservoir tank and when completed, the siphon drain valve will loose its prime automatically. The flow capacity of the solenoid operated siphon drain valve is considerably larger than the flow capacity of the inlet water supply line, thus, while the reservoir tank is being drained, fresh water will continuously be supplied to the tank and this will dilute the water that is being drained. This dissolution will dissolve some of the minerals which were previously precipitated and they will exit the reservoir tank along with the draining water. When the tank is emptied, the siphon drain valve will automatically lose its prime as mentioned above, which allows the incoming fresh water to refill the reservoir tank. During refilling of the tank, the solenoid operated siphon drain valve is deenergized and the pump is switched on, thus returning the evaporative cooler to its normal operating mode.

This flushing, draining and water replacement operational mode may be accomplished manually or at predetermined time intervals by employing a suitable timing mechanism to achieve the desired operational control of the pump and the solenoid operated siphon drain valve. In either case, it is not necessary that the delivery of the evaporatively cooled air be interrupted, in that the wetted cooler pads will remain wet enough throughout the flushing and draining mode to achieve an acceptable amount of cooling.

In the draining operation mode, both the pump and the fresh water inlet supply line are shutoff and the solenoid operated siphon drain valve is operated to completely drain the evaporative cooler, with such draining being employed when operation of the cooler is being terminated.

By placement of the tank below the floor pan of the cooler, water will never stand in the floor pan which reduces scaling and corrosion of the pan itself and the other cooler components, and will also reduce the cooler's direct exposure to a water body having a relatively large surface area. Even further reduction of such direct exposure of the cooler is achieved by providing the tank with a cover that is spaced above the opening formed through the cooler's floor pan. This same positioning of the reservoir tank below the floor pan eliminates the need for a flow checking valve as in the hereinbefore described prior art structure, thus eliminating, or substantially reducing, the possibility of scaling, corrosion, or contamination causing the apparatus of the present invention to become inoperative.

In the apparatus of the present invention, the inlet to the siphon drain valve is located in a downwardly upset dimple, or depression, formed in the bottom of the tank so that the inlet is located below the bottom of the tank. This, in conjunction with the lack of a check valve, allows complete and automatic drainage of the water from the cooler and from the tank in a draining mode when both the pump and the water supply line are shutoff.

Although the above described first embodiment of the apparatus of the present invention is suitable for use in newly manufactured evaporative coolers and may be added to existing units, its incorporation into existing units may be a task that some will not wish to undertake, and it may be beyond the capabilities of others. Therefore, the above described first embodiment is intended primarily for incorporation in newly manufactured coolers and a second embodiment of the present invention, now to be described, is intended primarily for retrofit installation, although it too may be used in newly manufactured coolers.

In the second embodiment, the evaporative cooler is not modified in any way, thus, its floor pan will function as a reservoir or sump, and the pump and the fresh water inlet valve are mounted as usual in such structures. A solenoid operated siphon drain valve, similar to that utilized in the first embodiment, is mounted in the cooler's floor pan by simple threaded attachment to the drain outlet provided in all such structures. The solenoid operated drain valve, which may be operated manually, or under control of a suitable timing device, will accomplish the flushing and draining operational modes when mounted in the cooler's floor pan in the same manner as those functions were accomplished in the reservoir tank of the previously described first embodiment.

Accordingly, it is an object of the present invention to provide a new and improved automatic flushing and draining apparatus for use in evaporative coolers.

Another object of the present invention is to provide a new and improved flushing and draining appratus for use in evaporative coolers which has a flushing, draining and water replacement operational mode that is employed at desired time intervals to flush the cooler and replace its contaminated saline water supply with fresh water, to reduce premature component failures, scaling, calcification and rusting of the cooler.

Another object of the present invention is to provide a new and improved automatic flushing and draining apparatus for use in evaporative coolers which has a draining operational mode that is used to drain the contaminated saline water supply from the evaporative cooler when its operation is being terminated.

Another object of the present invention is to provide an apparatus of the above described character which may be manually operated or may be under control of a suitable timing device.

Another object of the present invention is to provide an apparatus of the above described character which includes a solenoid operated siphon drain valve which is employed to drain the cooler's contaminated saline water supply in both the flushing and draining operational mode and in the draining operational mode of the apparatus.

Another object of the present invention is to provide an apparatus of the above described type wherein the solenoid operated drain valve is mounted in the floor pan of the evaporative cooler so that it is utilized to accomplish either the flushing, draining and water replacement operation, or the draining operation on the cooler's water supply which is contained in the floor pan.

Another object of the present invention is to provide an apparatus of the above described character wherein the solenoid operated drain valve is mounted in a reservoir tank provided below an opening formed in the cooler's floor pan so that it is utilized to accomplish either the flushing, draining and water replacement operation or the draining operation on the cooler's water supply which is contained in the remotely located reservoir tank.

The foregoing and other objects of the present invention as well as the invention itself, will be more fully understood from the following description when read in conjunction with the accompanying drawings.

DESCRIPTION OF THE PREFERRED EMBODIMENTS

Figure 1:
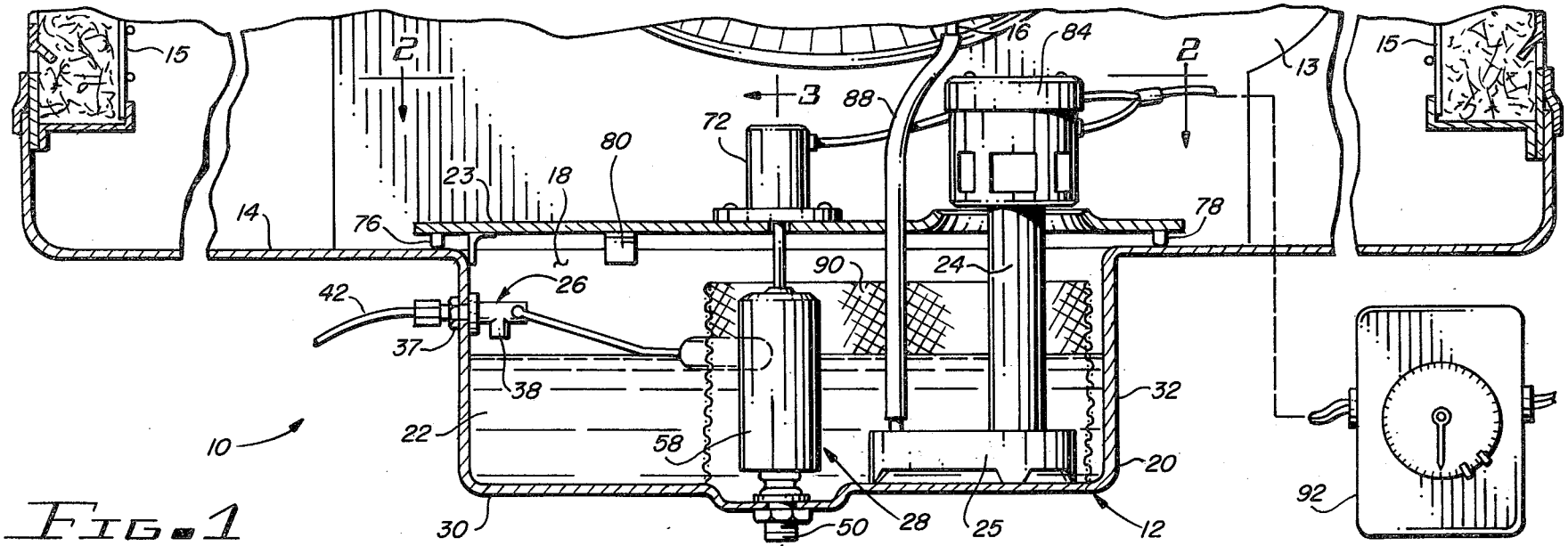
FIG. 1 is a fragmentary sectional view of a typical evaporative cooler which includes a first embodiment of the automatic flushing and draining apparatus of the present invention.

Referring more particularly to the drawings, FIG. 1 shows a fragmentary portion of a typical evaporative cooler, which is indicated generally by the reference numeral 10, with that evaporative cooler including a first embodiment of the automatic flushing and draining apparatus of the present invention, with the apparatus being indicated in its entirety by the reference numeral 12.

The evaporative cooler 10 includes, among other things, an air moving blower assembly 13, a floor pan 14, wettable cooler pads 15, and a water distribution plumbing system or network 16. Since evaporative coolers are well known in the art, it is not deemed necessary to completely illustrate such a structure and only a brief description of operation will be given to facilitate understanding of the apparatus of the present invention.

Typically, water under pressure is supplied to the plumbing system 16 which carries the water to the upper portion of the cooler's cabinet and distributes is to the top of each of the cooler pads 15. The cooler pads are thus wetted so that air being drawn into the cabinet through the pads by means of the air moving blower assembly 13, will be cooled by evaporation. Some of the water trickling down through the cooler pads 15 will, of course, evaporate and the remaining unevaporated water will drain into the cooler's floor pan 14.

In accordance with the present invention, the floor pan 14 of the evaporative cooler 10 is provided with an opening 18 so that the unevaporated water draining from the cooler pads 15 will pass through the opening 18 into the automatic draining and flushing apparatus 12 of the present invention.

As will hereinafter be described in detail, the automatic flushing and draining apparatus 12 of the present invention, includes the major components of a tank 20 for containing the water 22 that is used in operation of the cooler 10, a cover 23 for the tank, a pump 24 having an inlet, or suction end 25, for supplying the water 22 to the cooler, a float controlled shutoff valve 26 for initially supplying the water 22 to the tank and periodically supplying makeup water thereto, and a solenoid operated siphon drain valve 28 which is employed for draining purposes.

Figure 2:
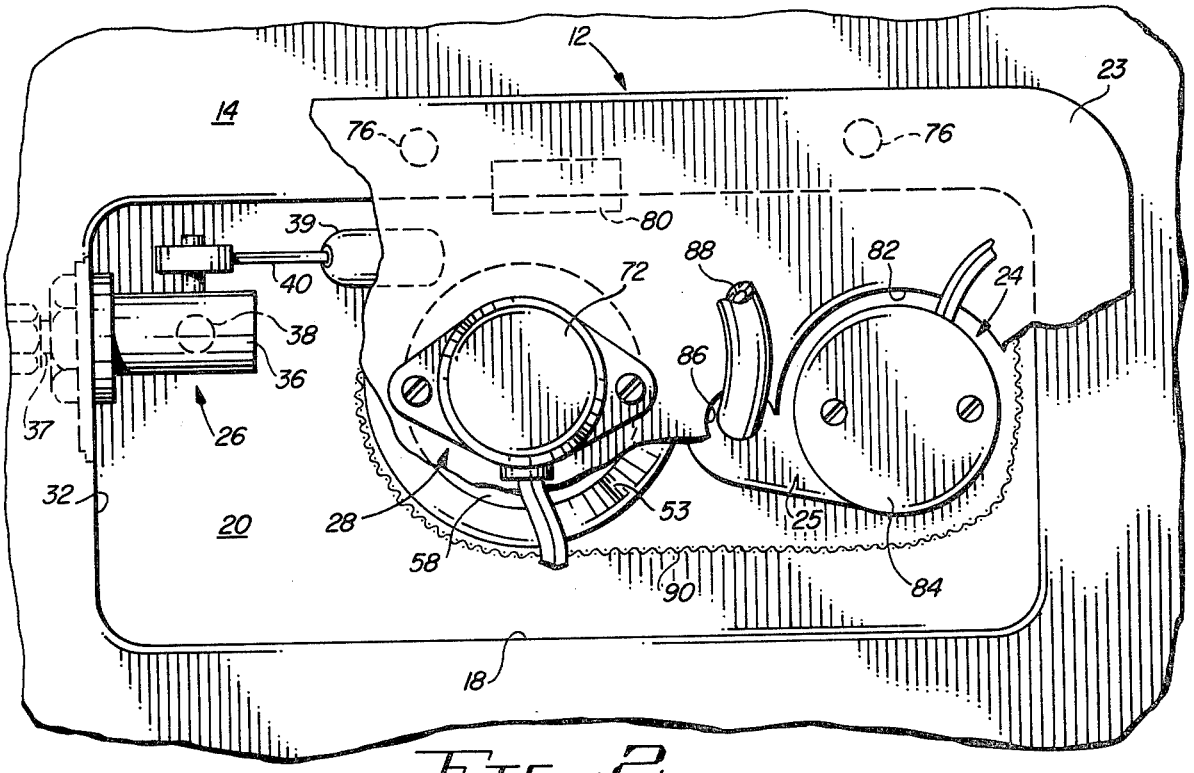
FIG. 2 is an enlarged fragmentary plan view taken along the line 2—2 of FIG. 1.
Figure 4:
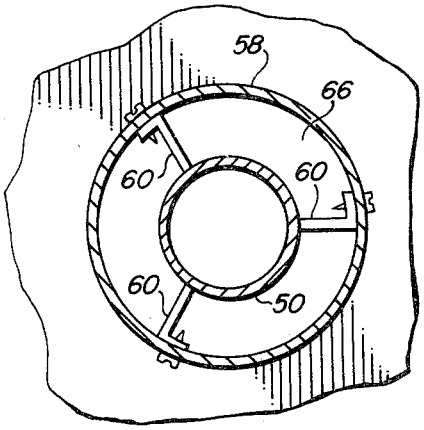
FIG. 4 is a fragmentary sectional view taken on the line 4—4 of FIG. 3.

As seen in FIGS. 1 and 2, the tank 20 is an upwardly opening structure having a bottom floor or wall 30 with integral upstanding sidewalls 32. The tank may be of any convenient configuration, such as the rectangular shape shown, and may be formed integral with the floor pan 14 such as by a well known metal drawing operation, or the tank may be mounted to the bottom of the floor pan 14 in any suitable manner so as to be located below the opening 18 formed therethrough.

The float controlled shutoff valve 26 includes the usual valve assembly 36 having a water inlet boss 37, a water outlet boss 38, and is operated in the well known manner by a float 39 which is carried on the extending end of a rod 40 that is connected to the operating parts (not shown) of the valve assembly. A water supply line 42 has one of its ends suitably connected to the water inlet boss 37 of the valve assembly 36 which is mounted in one of the sidewalls 32 of the tank 20, and its opposite end (not shown) is for connection to a suitable source of water under pressure such as a domestic water supply line. In this manner, the water 22 will be initially supplied to the tank 20 and there after will be periodically reopened under control of the float 39 to supply makeup water thereto and thus maintain the water level in the tank at a predetermined normal operating level 44 as seen best in FIG. 3.

The pump 24 may be of any suitable type which will pump the water 22 from the tank 20 into the water distribution plumbing network 16 of the evaporative cooler 10.

Figure 3:
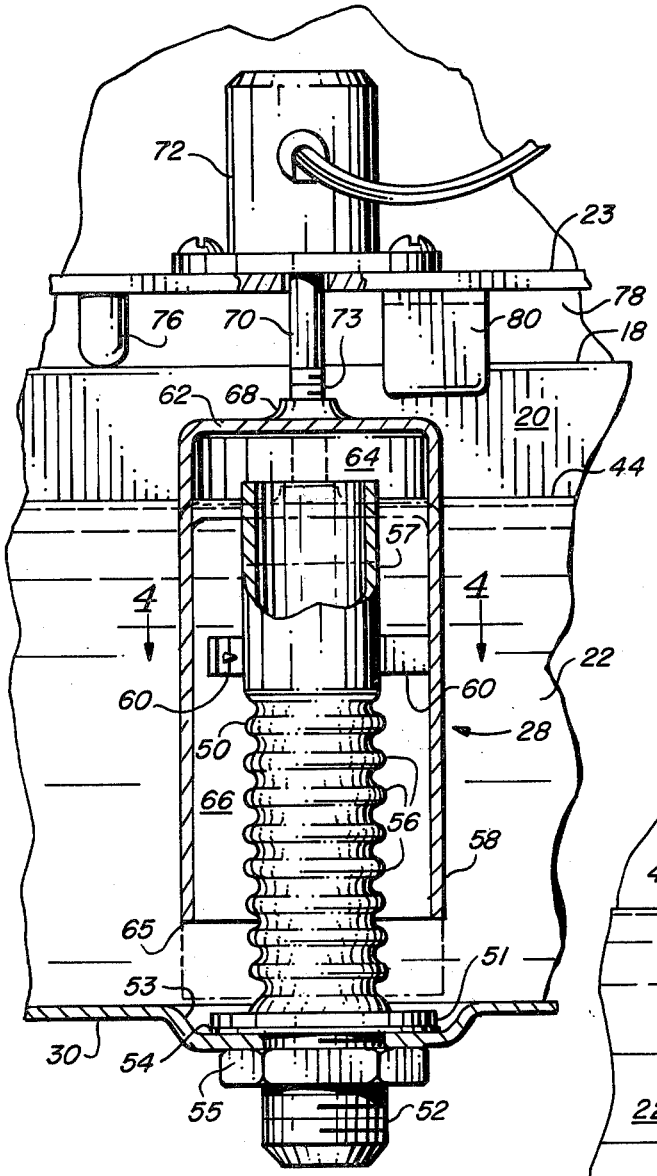
FIG. 3 is an enlarged fragmentary sectional view taken along the line 3—3 of FIG. 1.

The solenoid operated siphon drain valve 28, as seen best in FIG. 3, includes an especially configured standpipe 50 which is open at both ends and is provided with an annular flange 51 adjacent its depending end and is externally threaded as at 52. The threaded depending end 52 passes through an opening that is located in a downwardly depressed dimple 53 formed in the floor 30 of the tank 20 and a suitable sealing gasket 54 is interposed between the lower surface of the flange 51 and the upwardly facing surface of the dimple 53. A suitable nut 55 is carried on the depending threaded end 52 to mount the standpipe 50 in the tank 20 in a leak proof upstanding manner. The standpipe 50 is formed with convolutions 56 which extend upwardly from the annular flange 51 to proximate the upstanding end 57 thereof. The convolutions 56 act in a bellows-like fashion, thus allowing the standpipe 50 to be collapsed, i.e., reduced in its overall length, for reasons which will hereinafter be described in detail.

The solenoid operated siphon drain valve 28 also includes a downwardly opening cylindrical cap 58 which is fixedly carried on the standpipe 50 so as to be coaxial therewith with the fixed mounting being accomplished in any suitable way, such as by the radial struts 60 which extend from the upstanding end of the standpipe 50 into affixed engagement with the cylindrical cap 58. Mounting of the cylindrical cap is accomplished in a manner which locates its closed top end 62 above the open upstanding end 57 of the standpipe 50 to provide an open water passage zone 64 therebetween with it being seen that the zone 64 is located above the normal level 44 of the water in the tank 20. The cylindrical cap 58 is provided with an elongated skirt portion which depends from its closed upper end and has an endless bottom edge 65 which circumscribes the open bottom end of the cylindrical cap. The diameter of the cylindrical cap 58 is significantly larger than the diameter of the standpipe 50 to provide an annular water flow passage 66 which extends between the open bottom end of the cap 58 and the water passage zone 64 provided at the closed upper end thereof.

The closed upper end 62 of the cylindrical cap 58 is provided with means, such as the illustrated internally threaded axially upwardly extending boss 68, by which attachment of the depending actuator rod 70 of a solenoid 72 is accomplished, for reasons which will hereinafter be described in detail.

The solenoid 72 is mounted on the cover 23 so as to be supported above the cylindrical cap 58 and in axial alignment therewith. The actuator rod 70 depends from the solenoid and extends through a hole provided in the cover 23 and has its threaded lower end 73 attached to the cylindrical cap 58.

The solenoid 72 is shown in FIG. 3 as having its actuator rod 70 in the retracted position which is the deenergized state of the solenoid as will hereinafter be described in detail. Due to the attachment of the actuator rod 70 to the cap 58 which is in turn fixedly attached to the standpipe 50, the standpipe will be in its axially extended position when the solenoid 72 is deenergized. In this state, the water passage zone 64, provided between the upper end of the standpipe 50 and the closed upper end of the cylindrical cap 58, will be positioned above the normal water level 44 of the reservoir tank, and this constitutes a non-primed position of the solenoid operated siphon drain valve.

As is common in known solenoids, they may be biased in one direction, such as by using an internal spring (not shown). This may be the case with the solenoid 72, it may be biased so that when deenergized, ita actuator rod 70 will be in the retracted position which places the standpipe 50 in its axially extended position, thus placing the solenoid drain valve 28 in its non-primed state as described above.

The standpipe 50 shown in FIG. 3 is preferably formed of a rigid, or semi-rigid material, such as metal, which is resilient so that when the axially shortening force is applied thereto, the top open end thereof will move downwardly, and when that force is removed, the standpipe will inherently return to its axially extended state due to the resiliency of the material of which the standpipe 50 is fabricated. From this, it will be seen that the standpipe 50 is naturally biased to its axially extended state which is the non-primed position of the solenoid operated siphon drain valve 28. This natural bias exerted by the standpipe 50 may be used in lieu of the above described solenoid bias, or may be used in conjunction therewith.

Thus, the solenoid operated siphon drain valve 28 is a normally non-primed device, that is moved to its primed position when the solenoid 72 is energized. When the solenoid 72 is energized, its actuator rod 70 will push down on the cylindrical cap 58 to move the standpipe 50 to its axially shortened, or collapsed position. When this occurs, the water passage zone 64 will be moved downwardly as shown in dashed lines in FIG. 3, so that it will be below the normal water level 44 of the reservoir tank 20 which allows the water 22 to flood the water passage zone 64. This, of course, primes the solenoid operated siphon drain valve 28 so that the water 22 will flow therethrough and result in draining of the reservoir tank 20.

When the solenoid operated siphon drain valve 28 is in its primed position as a result of actuation of the solenoid 72, the endless bottom edge 65 of the cylindrical cap 58 is moved downwardly so that it is positioned within the downwardly depressed dimple 53 formed in the floor 30 of the reservoir tank 20, and is thus below the floor of the tank. With such a relationship, the tank 20 will be completely drained when the solenoid operated siphon drain valve is moved to its primed position, and only a small amount of water located within the dimple 53 will remain when the prime is lost as a result of completion of the draining operation.

The cover 23 is a substantially planar structure of rectangular configuration similar to that of the tank 20, and is somewhat larger than the opening 18 so that the peripheral edge of the cover extends beyond the opening. A plurality of spacers 76 are suitably affixed to the downwardly facing surface of the cover 23 and are adjusted the peripheral edge thereof, and the spacers 76 are in resting engagement with the upwardly facing surface of the floor pan 14 of the cooler 10. Thus, the cover 23 is parallel with the bottom of the floor pan 14 and is in spaced overlaying relationship with respect to the opening to provide a gap 78 through which the water returning from the pads 15 is free to enter the tank. The cover 23 is demountably supported as described above and is provided with a plurality of cover stabilizing tabs 80 which depend from the cover into bearing engagement with the interior surfaces of the sidewall 32 of the tank 20. The cover 23 is provided with a suitable opening 82 through which the pump 24 extends upwardly so that the drive motor 84 of the pump will be located in the relatively drier environment of the cooler cabinet. Also, the cover 23 is provided with another opening 86 through which a suitable hose 88 passes with the hose being used for connecting the pump 24 to the cooler's plumbing system 16. The cover 23, in addition to supporting the solenoid, shields the interior of the evaporative cooler 10, and its components, from direct exposure to the water 22 within the tank 20 and will thus reduce the moisture content and mineral deposition within the cooler.

The automatic flushing and draining apparatus 12 of the present invention is preferably provided with a screen 90. The screen is seen to be an endless upstanding structure which is supportingly carried on the floor 30 of the tank 20 and is configured to circumscribe the solenoid operated siphon drain valve 28 and the inlet end 25 of the pump 24. The screen 90 is used to prevent relatively large foreign objects, such as dislodged wood shavings from the excelsior pads 15 of the cooler 10, from passing into the siphon drain valve 28 and/or the pump 24 and clogging or otherwise interfering with the operation thereof.

Operation

The water 22 in the tank 20 will become increasingly contaminated with dirt and the like during normal operation of the evaporative cooler, and more importantly will become highly saline due to increasing concentrations of mineral salts. Thus, periodic flushing and replacement of the water is desirable to prolong the life of the cooler. Periodic draining, flushing and replacement of water may be accomplished by shutting off the power to the pump 24 and actuating the solenoid operated siphon drain valve 28. As hereinbefore described, energization of the solenoid 72 will place the solenoid operated siphon drain valve 28 in its primed position, and the water 22 contained within the tank 20, along with the unevaporated water returning to the tank from the cooler, will be drained therefrom. It will be noted that the size of the standpipe 50 is considerably larger in diameter than the water supply line 42, therefore, the rate at which the tank 20 is drained is considerably faster than the incoming rate of fresh water supplied through the float controlled shutoff valve 26. In this manner, a flushing action will take place and when the drainage is complete, the solenoid operated siphon valve 28 will lose its prime and the incoming fresh water will fill the tank 20 to the normal operating valve 44 and normal operation of the evaporative cooler 10 will be resumed. At some point between the time when the solenoid operated siphon drain valve 28 loses its prime and the time when the water reaches its normal level 44, the power is turned on to operate the pump 24 and deenergize the solenoid to return the siphon drain valve to its normal non-primed position.

The above described operational mode, wherein the tank 20 is drained, flushed and refilled with fresh water, should be accomplished at periodic intervals during operation of the cooler 10 as mentioned above, and a second, or draining operational mode is employed when cooler operation is to be terminated. The draining operational mode, which is used at the end of a cooling season, or at other times of anticipated prolonged nonuse, is accomplished by shutting off the power to the pump 24, momentarily energizing the solenoid 72 and shutting off the incoming fresh water supplied to the tank 20. Such action will prime the solenoid operated siphon drain valve 28 in the above described manner and complete drainage will result. Complete drainage is desirable so that the cooler 10 will not contain a standing body of water during periods of nonuse.

As mentioned above, momentary energization of the solenoid 72 is all that is needed to accomplish the draining operational mode. Once the solenoid operated siphon drain valve is primed, tank drainage will proceed to completion regardless of the energized or deenergized state of the solenoid.

It should be noted that by shutting off the pump 24 in the absence of solenoid energization, such as in the event of power failure during normal cooler operation, or failure of the operator to momentarily energize the solenoid 72 when placing the apparatus in a draining operational mode, at least partial water drainage will automatically result.

In the absence of solenoid energization during normal cooler operation when power is interrupted to the pump, the water contained in the cooler's water distribution plumbing network 16 and in the cooler pads 15 will return to the tank 20. This returning water will add to the water already in the tank 20 and result in raising of the normal water level 44. The amount of returning water may vary due to such things as the size of the cooler 10, the rate of evaporation taking place in the pads 15 and the like. Under ideal conditions, i.e., the quantity and speed of the returning water, proper tank and the like, the water level in the tank will be raised enough to prime the siphon drain valve, and a normal draining, flushing and replacement of the water will take place. However, in less than ideal conditions the siphon drain valve may not be primed and in such a condition, the standpipe 50 will act as an overflow pipe, and drains an amount approximately equal to the returning water. When normal cooler operation resumes, i.e., the pump 24 is returned to operation, incoming fresh water will replace that which was drained by overflow action through the standpipe 50 of the solenoid operated siphon drain valve 28.

This same self-priming or overflow partial drainage will occur when the apparatus is placed in the draining operational mode in the absence of momentary solenoid actuation.

When the above described self-priming occurs, the contaminated highly saline water in the cooler 10 will, of course, be completely drained and subsequently replaced with fresh water. When the overflow partial drainage occurs, subsequent fresh water replacement will dilute the non-drained contaminated highly saline water and improve its condition to a limited extent.

The above described apparatus of the present invention is automatic only to the extent that it will automatically drain, flush and refill the tank in response to the pump 24 being shutoff and the solenoid 72 being energized to prime the solenoid operated siphon drain valve 28, and this may be accomplished manually. However, due to the desirability of periodically switching the apparatus to its draining, flushing and water replacement operational mode, it is preferred that the apparatus be implemented as a fully automatic system.

Figure 7:
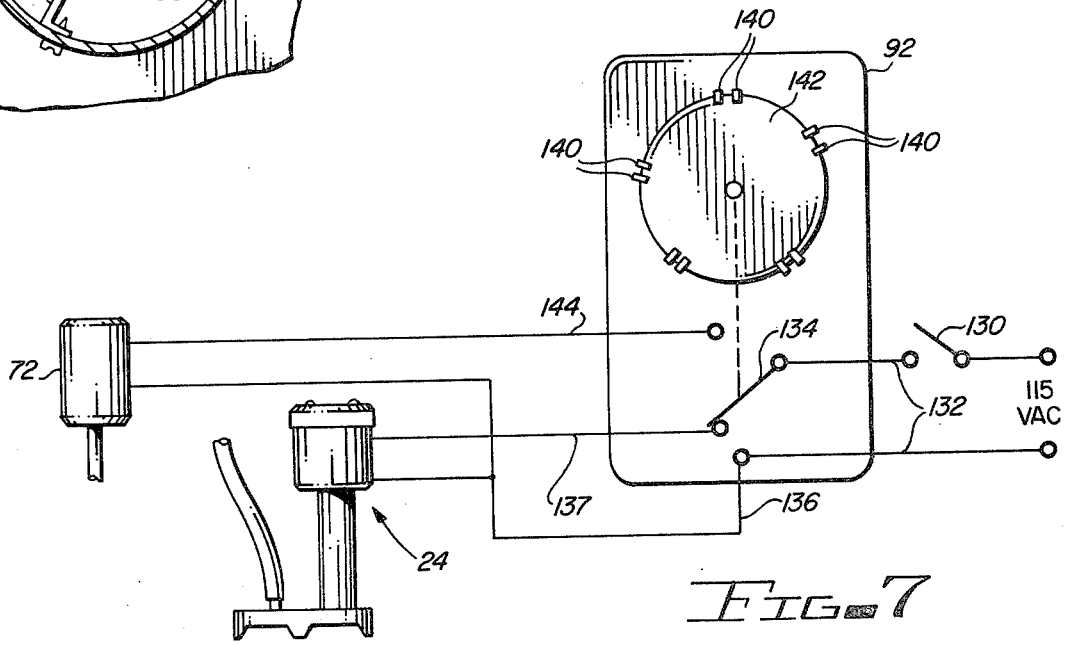
FIG. 7 is a schematic diagram showing a timing device and associated electrical wiring needed when the timing device is used in conjunction with the apparatus of the present invention.

As will hereinafter be described in detail, the preferred form of automatic equipment for use in conjunction with the apparatus of the present invention is a clock timing device 92 which as shown in FIGS. 1 and 7 is connected in the power lines leading to the pump 24 and to the solenoid 72.

Figure 5:
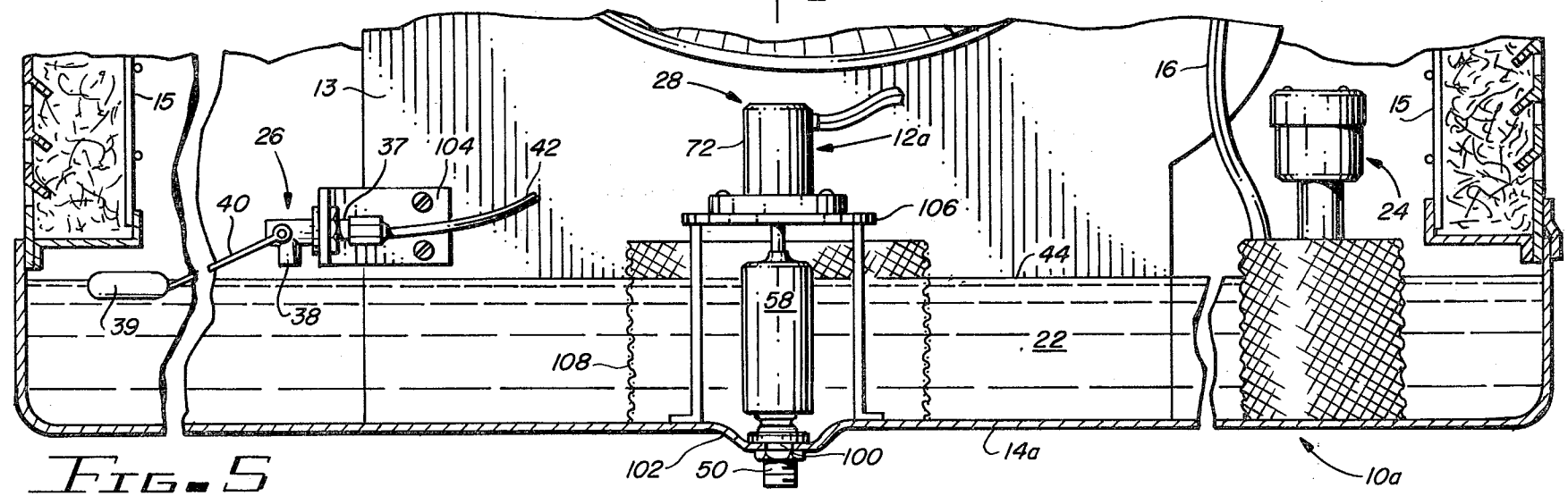
FIG. 5 is a fragmentary sectional view similar to FIG. 1 and showing a second embodiment of the apparatus of the present invention.

Reference is now made to FIG. 5 wherein a second embodiment of the apparatus of the present invention, which is indicated generally by the reference numeral 12*a* is shown as being mounted in an evaporative cooler 10*a*.

The evaporative cooler 10*a* includes, among other things, the usual air moving blower assembly 13, wettable cooler pads 15, water distribution system 16, floor pan 14*a* which differs from the previously described floor pan 14 in that it is, as is customary in such structures, not provided with the reservoir tank 20 of the first embodiment of the present invention. The floor pan 14*a* is provided instead with a drain opening 100 located within a downwardly depressed dimple 102. As is also customary in evaporative coolers, the pump 24 is positioned in any convenient location within the floor pan 14*a*, and likewise, the float operated fresh water inlet valve 26 is mounted, such as by a suitable bracket 104 so that it deposits the incoming fresh water in the floor pan 14*a*. Thus, the floor pan 14*a* of the evaporative cooler 10*a* is a sump, or reservoir which contains the water 22 which is used in operation of the cooler, and similar to the first embodiment, this water supply 22 has a normal operating level 44 which is maintained by operation of the float control shutoff valve 26.

In an evaporative cooler configured in this manner, the second embodiment of the automatic flushing and draining apparatus 12*a* of the present invention is seen to include the solenoid operated siphon drain valve 28 which is mounted in drain opening 100 of the floor pan 14*a* in exactly the same manner as the hereinbefore described mounting thereof in the tank 20. The only difference being that the solenoid 72 is supportingly mounted on a support means 106 which may take the form of the stand shown in FIG. 5, or may be of any other suitable configuration such as a bracket (not shown) which is mounted on the side of the blower device 13. FIG. 5 shows that the solenoid operated siphon drain valve of this embodiment of the present invention may also be circumscribed by an upstanding screen 108 which prevents foreign objects from entering into and interfering with the siphon drain valve.

Since the solenoid operated siphon drain valve 28 of this embodiment is identical with that previously described, it will operate in the same manner and it is deemed that repeating the operational description would be redundant. The only operational difference is that in this second embodiment, the amount of water contained within the floor pan 14*a* is considerably greater than the amount containable in the reservoir tank 20, and this, of course, will require that it will take longer to accomplish the draining, flushing and water replacement operation, and the time clock 92 (FIGS. 1 and 7) will have to be appropriately reset if such a device is used.

Figure 6:
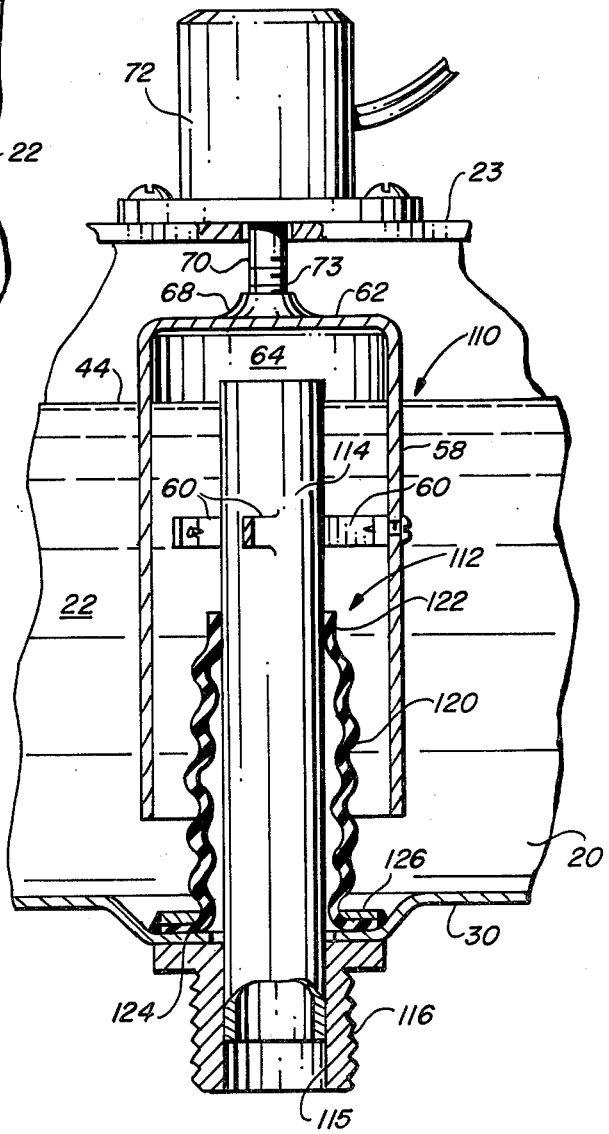
FIG. 6 is a fragmentary sectional view similar to FIG. 3 and showing a modification of the apparatus of the present invention.

Reference is now made to FIG. 6 wherein a modified form of the solenoid operated siphon drain valve is shown with this modified form being indicated generally by the reference numeral 110. The solenoid operated siphon drain valve 110 includes the same hereinbefore described solenoid 72 the actuator rod 70 of which is attached to the closed top 62 of the downwardly opening cylindrical cap 58. The cap 58 is fixedly mounted, such as by means of the struts 60, to a modified form of standpipe 112.

The standpipe 112, instead of being an axially collapsible structure as was the case in the hereinbefore described standpipe 50, is a conventional conduit or tube 114 which is axially movable in the bore 115 of a fitting 116 carried on the bottom 30 of the tank 20 in the case of the embodiment of FIG. 1, or on the floor of the cooler pan 14*a* in the case of the embodiment of FIG. 5. In either case, the fitting 116 is fixedly mounted, such as by welding, so as to depend from the bottom 30, or the floor of the pan 14*a*, and is in axial alignment with the drain opening thereof.

A flexible boot 120, such as of rubber, is coaxially mounted on the axially movable tube 114 and is formed with a cylindrical collar 122 at its upper end which is adhesively, or otherwise sealingly attached to the periphery of the tube. An endless flange 124 is formed on the lowermost end of the boot 120 and is in leakproof sealed engagement with the upwardly facing surface bottom 30 of the tank 20, or the upwardly facing surface of the floor of the cooler's pan 14*a*. Such sealed affixation of the flange portion 124 may be accomplished in any suitable manner, such as with an adheasive or by being interposed between the bottom 30 of the tank 20, or the floor of the pan 14*a*, and a washer 126 which is welded, or otherwise mounted so as to exert a squeezing force on the flange 124.

Although the solenoid operated siphon drain valve 110 operates on a somewhat different principle in comparison to the solenoid operated siphon drain valve 28, the end result is the same. That is, the open water passage zone 64 provided between the closed top 62 of the cap 58 and the open upper end of the standpipe 112, is moved downwardly when the solenoid 72 is actuated, and this results in priming of the solenoid operated siphon drain valve 110.

Since the flexible boot 120 will do little or nothing with regard to returning the tube 114 to its upwardly disposed position when a draining operation has been completed, the solenoid 72 will have to perform that function such as by using a solenoid which is internally biased as hereinbefore described.

Reference to now made to FIG. 7, wherein the clock timing device 92 is best seen, and wherein a suggested form of wiring schematic is disclosed. Electric power from a suitable remote source is coupled through a suitable on/off switch 130 to the clock timing device 92 by conductors 132. A switch 134, which may be provided internally of the device 92, is coupled so as to be controlled by the clock actuated mechanism (not shown) of the device. When the clock timing device 92 is in one state, which may be described as its normal pump operated position, the switch is positioned to couple power from the conductors 132 to the pump through conductors 136 and 137. When the clock timing device 92 switches itself to its second state, which may be described as its solenoid operating position, as it will do at various time intervals, as determined by the numbers and spaced intervals of the lug-pairs 140 provided on the rotating plate 142, the switch 134 will be repositioned so that power to the pump 24 is interrupted and is coupled via conductors 136 and 144 to the solenoid 72.

The number of lug-pairs 140 provided on the rotating plate 142 of the timing device 92 will determine the number of times that the apparatus will be switched to its draining, flushing and water replacing operational mode and back to its normal operational mode in a give period of time. For example, in the illustrated timing device 92, assuming that the rotating plate 142 will complete one revolution in 24 hours, the apparatus will be switched into its draining, flushing and water replacement operational mode five times in that 24 hour period due to the number of lug-pairs 140 provided on the plate 142. As is well known in the art, when a first one of the lugs of one of the lug pairs 140 is moved into engagement with the internal mechanism (not shown) of the timing device 92, the switch 134 will be moved from its pump operating position to its solenoid operating position, and when the second lug of that same lug-pair moves into contact with the internal mechanism of the clock timing device 92, the switch 134 will be returned from its solenoid operating position back to its pump operating position.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles.

The appended claims are therefore intended to cover and embrace any such modifications within the limits only of the true spirit and scope of the invention.

What I claim is:

1. An automatic flushing and draining apparatus for an evaporative cooler comprising:

(a) an evaporative cooler including a sump means in the bottom thereof for containing a water supply used in operation of said evaporative cooler;

(b) shutoff valve means for supplying water from an external source to the sump means of said evaporative cooler and maintaining it at a predetermined operating level;

(c) a siphon drain valve mounted in the sump means of said evaporative cooler and having a water inlet adjacent its lower end and a water passage zone at its upper end, said siphon drain valve being vertically movable between an upwardly extended position wherein its water passage zone is located above the operating water level in the sump means of said evaporative cooler and a downwardly disposed position wherein its water passage zone is located below the operating water level in the sump means of said evaporative cooler; and (d) means coupled to said siphon drain valve and having a first state wherein said siphon drain valve is in its axially upwardly extended position and a second state which moves said siphon drain valve to its axially downwardly disposed position for priming thereof.

2. An automatic flushing and draining apparatus as claimed in claim 1 and further comprising timing means coupled to said means for switching thereof between its first and second states at predetermined intervals.

3. An automatic flushing and draining apparatus as claimed in claim 1 wherein said means comprises a solenoid.

4. An automatic flushing and draining apparatus as claimed in claim 1 wherein said means comprises a solenoid which when deenergized is in its first state wherein said siphon drain valve in its axially upwardly extended position and when energized is in its second state which moves said siphon drain valve in its axially downwardly disposed position.

5. An automatic flushing and draining apparatus as claimed in claim 4 and further comprising a timing means in the power supply line of said solenoid to periodically couple power thereto for changing it from its first state to its second state at predetermined time intervals and returning it to its first state after a predetermined time of power application.

6. An automatic flushing and draining apparatus as claimed in claim 5 wherein said timing means is also in the power supply line of said pump means for interrupting power to said pump means when said timing means is supplying power to said solenoid.

7. An automatic flushing and draining apparatus as claimed in claim 1 wherein the flow capacity of said siphon drain valve is larger than the flow capacity of said shutoff valve means whereby the water supplied by said shutoff valve means will flush said sump means when said siphon drain valve has been axially moved to its downwardly disposed position for priming thereof and is operating to drain said sump means.

8. An automatic flushing and draining apparatus as claimed in claim 1 and further comprising an upstanding screen supported on the bottom of said sump means and configured to circumscribe the water inlet of said siphon drain valve to prevent the entry of foreign material thereinto.

9. An automatic flushing and draining apparatus as claimed in claim 1 wherein said siphon drain valve comprises:

(a) a standpipe mounted in the bottom of said sump means with its bottom end attached and passing through the bottom of said sump means and having an upper end, said standpipe having means formed therein which allows axially extending and axially collapsing movement thereof; and (b) a cylindrical cap coaxial with said standpipe and attached thereto for movement therewith, said cylindrical cap having a closed upper end which is spaced above the upper end of said standpipe to define the water passage zone therebetween and having an endless skirt integrally depending from its closed upper end, the inside diameter of the depending skirt being larger than the outside diameter of said standpipe and having an endless bottom edge which defines the water inlet of said siphon drain valve.

10. An automatic flushing and draining apparatus as claimed in claim 9 wherein the means formed in said standpipe which allows axial extension and axial collapsing thereof includes an axially extending series of convolutions formed in the sidewall of said standpipe.

11. An automatic flushing and draining apparatus as claimed in claim 9 wherein said sump means is formed with a downwardly upset depression formed in the bottom thereof with an outlet opening formed through the bottom of said depression, said standpipe being mounted in said outlet opening and the water inlet of said siphon drain valve being located within said depression when said siphon drain valve is moved to its axially collapsed position.

12. An automatic flushing and draining apparatus as claimed in claim 1 wherein said siphon drain valve comprises:

(a) said sump means having a drain outlet opening means formed in the bottom thereof;

(b) a tubular standpipe mounted axially in the opening means of the bottom of said sump means and axially vertically movable therein between an upwardly extending position and a downwardly disposed position;

(c) a flexible boot coaxial with said tubular standpipe, said flexible boot having one of its ends in sealed engagement with the periphery of said tubular standpipe and having its other end in sealed engagement with the bottom of said sump means; and (d) a cylinder cap coaxial with said tubular standpipe and said flexible boot, said cap attached to said tubular standpipe for movement therewith, said cap having a closed upper end which is spaced above the upper end of said tubular standpipe to define the water passage zone therebetween and having an endless skirt integrally depending from its closed upper end, the inside diameter of the depending skirt of said cap being sized to define a water flow passage between the depending skirt and the periphery of said flexible boot and having an endless bottom edge which defines the water inlet of said siphon drain valve.

13. An automatic flushing and draining apparatus as claimed in claim 12 wherein the drain outlet opening means of said sump means is located in a downwardly upset depression formed in the bottom of said sump means so that endless bottom edge of said cylindrical cap will move into the depression when said tubular standpipe is moved into its downwardly disposed position.

14. An automatic flushing and draining apparatus as claimed in claim 1 wherein said evaporative cooler further includes a floor pan which forms the sump means thereof.

15. An automatic flushing and draining apparatus as claimed in claim 14 and further comprising means in said evaporative cooler for supporting said means which is coupled to said siphon drain valve in operating relationship therewith.

16. An automatic flushing and draining apparatus as claimed in claim 1 and further comprising:

(a) said evaporative cooler having a floor pan with an opening formed therethrough; and (b) a tank depending from the floor pan of said evaporative cooler below the opening formed therethrough, said tank opening upwardly into said floor pan and having a cross sectional area which is less than the cross sectional area of the floor pan of said cooler with the opening of said tank being approximately equal to the cross sectional area of said tank and approximately equal to the area of the opening formed in the floor pan of said cooler, said tank forming the sump means of said evaporative cooler.

17. An automatic flushing and draining apparatus as claimed in claim 16 and further comprising:

(a) a cover mounted in the floor pan of said evaporative cooler in upwardly spaced overlaying relationship with said upwardly opening tank; and (b) said means coupled to said siphon drain valve being supported by said cover in operating relationship with respect to said siphon drain valve.

* * * * *